US009599301B2

(12) United States Patent
Brendle

(10) Patent No.: US 9,599,301 B2
(45) Date of Patent: Mar. 21, 2017

(54) LIGHT MODULE

(71) Applicant: Automotive Lighting Reutlingen GmbH, Reutlingen (DE)

(72) Inventor: Matthias Brendle, Tuebingen (DE)

(73) Assignee: Automotive Lighting Reutlingen GmbH, Ruetlingen (DE)

( * ) Notice: Subject to any disclaimer, the term of this patent is extended or adjusted under 35 U.S.C. 154(b) by 79 days.

(21) Appl. No.: 14/049,718

(22) Filed: Oct. 9, 2013

(65) Prior Publication Data

US 2014/0104864 A1 Apr. 17, 2014

(30) Foreign Application Priority Data

Oct. 12, 2012 (DE) ..... 10 2012 218 684

(51) Int. Cl.
*F21S 8/10* (2006.01)

(52) U.S. Cl.
CPC ..... *F21S 48/12* (2013.01); *F21S 48/1159* (2013.01); *F21S 48/1241* (2013.01); *F21S 48/1258* (2013.01); *F21S 48/1266* (2013.01); *F21S 48/1291* (2013.01); *F21S 48/1329* (2013.01); *F21S 48/1388* (2013.01); *F21S 48/1747* (2013.01); *F21S 48/328* (2013.01)

(58) Field of Classification Search
CPC ..... B60Q 1/2696; F21S 48/10; F21S 48/12; F21S 48/115; F21S 48/1159; F21S 48/1163; F21S 48/125; F21S 48/2225; F21S 48/22; F21S 48/32; F21S 48/11
USPC ..... 362/543–545, 511, 538
See application file for complete search history.

(56) References Cited

U.S. PATENT DOCUMENTS 7,331,694 B2 * 2/2008 Lee et al. ..... 362/335
7,618,171 B2 11/2009 Tessnow et al.
(Continued)

FOREIGN PATENT DOCUMENTS

DE 10 2005 019 093 A1 10/2006
DE 60 2005 006 360 T2 6/2009
(Continued)

OTHER PUBLICATIONS

Jul. 9, 2013 Examination Report for DE 10 2012 218 684.0.
Official Report mailed Mar. 18, 2016 for European Application No. 13184394.8.

*Primary Examiner* — Jong-Suk (James) Lee
*Assistant Examiner* — Christopher Dunay
(74) *Attorney, Agent, or Firm* — Howard & Howard Attorneys PLLC

(57) ABSTRACT

A light module, comprising numerous semiconductor light sources for emitting light, a primary lens element for concentrating the light emitted from the semiconductor light sources in section perpendicular to a sagittal plane of the light module, wherein the primary lens element exhibits numerous disk-like light conducting sections, extending in a plane perpendicular to the sagittal plane, wherein each light conducting section exhibits a light coupling surface and a light decoupling surface, and is designed for conducting light, subjected to a total reflection, from the light coupling surface to the light decoupling surface, wherein a semiconductor light source is allocated to each light conducting section such that light form the semiconductor light source can be coupled with the respective light coupling surface in the light conducting section.

8 Claims, 11 Drawing Sheets

(56) References Cited

U.S. PATENT DOCUMENTS

| | | | | |
|---|---|---|---|---|
| 2003/0235046 | A1* | 12/2003 | Chinniah et al. | 362/31 |
| 2006/0007697 | A1* | 1/2006 | Ackermann | 362/520 |
| 2006/0083013 | A1* | 4/2006 | Wanninger et al. | 362/509 |
| 2008/0013333 | A1* | 1/2008 | Koizumi et al. | 362/511 |
| 2008/0080201 | A1 | 4/2008 | Specht et al. | |
| 2008/0080207 | A1* | 4/2008 | Specht et al. | 362/581 |
| 2009/0027911 | A1* | 1/2009 | Misawa et al. | 362/518 |
| 2009/0073710 | A1 | 3/2009 | Sormani et al. | |
| 2009/0091944 | A1* | 4/2009 | de Lamberterie . G02B 19/0061 | 362/516 |
| 2009/0129079 | A1* | 5/2009 | Grotsch G02B 17/08 | 362/235 |
| 2010/0226142 | A1* | 9/2010 | Brendle et al. | 362/512 |
| 2011/0080092 | A1* | 4/2011 | Matsumoto et al. | 315/82 |
| 2012/0176809 | A1* | 7/2012 | Ohno | 362/510 |
| 2013/0021815 | A1* | 1/2013 | Koizumi | 362/511 |
| 2013/0194816 | A1* | 8/2013 | Hager et al. | 362/487 |
| 2013/0223089 | A1* | 8/2013 | Danner et al. | 362/511 |
| 2013/0242590 | A1* | 9/2013 | Fedosik et al. | 362/521 |

FOREIGN PATENT DOCUMENTS

| | | |
|---|---|---|
| DE | 20 2011 103 703 U1 | 1/2012 |
| EP | 1 903 274 A1 | 3/2008 |

* cited by examiner

LIGHT MODULE

CROSS-REFERENCE TO RELATED APPLICATION

This application is based upon and claims priority to German Patent Application 10 2012 218 684.0 filed on Oct. 12, 2012.

BACKGROUND OF INVENTION

1. Field of Invention

The invention relates to a light module for motor vehicle headlights.

2. Description of the Related Art

In the present context, a light module is understood to be the actual light emitting unit that delivers the desired light beam distribution. This light module can be installed in a motor vehicle headlight, e.g. incorporated in a headlight housing. Depending on the field of application, the light beam distribution should exhibit certain, frequently government regulated, characteristic intensity distributions.

On the one hand, it is of interest to generate a dimmed light distribution, distinguished by a light/dark border that is substantially horizontal in sections. This light distribution exhibits a dark region vertically above the border, and a light region vertically below the border, wherein the light region is separated from the dark region by the light/dark border. For this, the brightest possible illumination is desired in the region directly beneath the light/dark border (low beam/spot light distribution), in order to obtain a sufficient range. Moreover, a sufficient illumination of the region in front of the vehicle or the regions to the side should be ensured (base-light light distribution). Light modules of this type can be used as low beams or fog lights.

Moreover, frequently a high beam light distribution is to be generated with motor vehicle headlights, exhibiting a high level of illumination in a region above the light/dark border (i.e. in the dark region of the low beam light distribution). The high beam distribution should be superimposed over the base-light distribution of the low beam light distribution in a manner that is homogenous to the greatest extent possible. By way of example, a disruptive stripe pattern in the transition between the different light distributions, particularly in the light/dark border, should be prevented.

Depending on the field of application, other light functions such as daytime running lights, demarcation lights, or signal lights should be provided. For this, usually a large portion of the light emitting surface of the light module should exhibit a spatially constant light density, in order to obtain the appearance of homogeneity to the greatest extent possible.

In order to implement the various light beam distributions, projection systems, on one hand, are known. These are usually two-step optical systems, in which light from a light source is deflected by a primary lens to the focal plane of a secondary lens, which projects light with the desired emitted light distribution. Due to the two-step structure, projection systems normally require a large assembly space along the beam path. Aside from this, reflection systems are known, in which a reflector is used to shape and deflect the light emitted from a light source into the emitted light distribution. For this, reflector surfaces that have a complex shape and are large are usually necessary in order to obtain the desired light distribution.

The use of LEDs is frequently desired as the light source for motor vehicle headlights, because these exhibit a comparatively low power consumption and a comparatively high efficiency in terms of power conversion. However, LEDs usually generate a lower luminous flux than gas discharge lamps or halogen lamps. For this reason, more LED light sources must be combined to form a light module in order to generate a sufficiently high luminous flux.

A light module of the type known in the related art is described in published US Pat. Application No. 2009/0091944 A1. In this case, the disk-like light conducting sections converge in the region of their light coupling surfaces. This can lead to problems regarding the exhaust heat of the semiconductor light sources allocated to the respective light coupling surfaces, because these are disposed in close proximity to one another. With the light module described therein, each light conducting section also exhibits a massive, cylindrical lens-type end piece at its light decoupling surface, which extends along the respective light decoupling surface. Due to the size of these end pieces, the light conducting sections must maintain a minimum spacing to one another in the region of their light decoupling surfaces. The light module thus has a comparably large light emitting section. Furthermore, there is a significant expenditure in terms of materials.

The objective of the invention is to eliminate the specified disadvantages of the known light module. In particular, a compact light module having semiconductor light sources is to be provided, which exhibits a high level of optical efficiency and which enables the generation of different light beam distributions with a single module.

SUMMARY OF THE INVENTION

The disadvantages in the related art are overcome in a light module of the present invention. The light module includes numerous semiconductor light sources, e.g. light emitting diodes (LED) for emitting light, and a primary lens element for concentrating the light emitted from the semiconductor light sources within sections perpendicular to a sagittal plane of the light module. The primary lens element exhibits numerous flat disk-like light conducting sections, extending perpendicular to the sagittal plane. Each light conducting section has a light coupling surface and a light decoupling surface, and is designed for conducting light with an internal total reflection, from the light coupling surface to the light decoupling surface. Internal total reflection occurs when a light beam hitting a boundary surface of the light conducting section forms an angle to the plane perpendicular to the boundary surface at the reflection point, which exceeds the critical angle of the total reflection, such that the law of refraction (Snell's law) provides no real solution for the refraction angle.

In the light module, a semiconductor light source is allocated to each light conducting section, such that the light from the semiconductor light source can be coupled by the respective light coupling surface in the light conducting section. Each light conducting section exhibits a convex curved main reflection surface, such that a primary focal line is defined, allocated in each case to the light conducting section. This is distinguished in that a light bundle, starting from the primary focal line, hitting the light coupling surface in a diverging manner, can be converted to a light bundle passing through the light decoupling surface, which is parallelized in sections perpendicular to the primary focal line. The primary focal lines each extend in, or parallel to, the sagittal plane.

With the light module according to the invention, a secondary lens, disposed downstream of the primary lens in the beam path, is provided for concentrating light within sections parallel to the sagittal plane. The secondary lens element is designed such that the light passing through the light decoupling surfaces of the numerous light conducting sections can be concentrated within sections parallel to the sagittal plane.

A sagittal plane is defined for the light module to help explain the invention. If, for example, the light module is installed in a motor vehicle headlight, then the sagittal plane can be the horizontal plane of the overall system, which spans a main beam direction of the light module and a horizontal axis, perpendicular to the main beam direction. Moreover, a meridional plane of the light module shall be referenced in the following. This is to be understood as that plane which is perpendicular to the sagittal plane, and is spanned by the surface norm of the sagittal plane and the main beam direction of the light module. By way of example, the meridional plane is that vertical plane in which the main beam direction of the light module runs. The specification of the horizontal or vertical relates thereby to a reference system for the light module. It is understood that the light module as a whole can also be used or installed with a tilted and skewed orientation.

The concentration of light within sections parallel to a plane is understood in the present context to mean that a light bundle diverging at a divergence angle in the respective section is converted to a light bundle that diverges within the respective section at a smaller angle, in particular, it runs in parallel ("collimation") or even converges ("bundling").

The light module according to the invention enables the integration of different light functions (e.g. low beams, high beams) in a single, compact light module. For each light conducting section, the optical characteristics, in particular the focal lengths of the respective light conducting sections, can be specified independently. The position of the respective semiconductor light source in relation to the allocated primary focal line determines the characteristics of the portion of the light beam distribution generated by the respective semiconductor light source. In this manner, it is possible to implement different light beam distributions with the different light conducting sections. The light module according to the invention can therefore be designed as a multi-functional light module.

The individual semiconductor light sources can be controlled electronically, or can be turned on and off, in particular, independently of one another. As a result, the different light functions can be electronically activated and deactivated (e.g. high beams or daytime running lights that can be turned on and off), without the need for moveable mechanical components.

The light conducting sections are designed to be disk-like in that each light conducting section exhibits a flat expansion and exhibits, in comparison to the dimensions along the flat expansion, a limited thickness. The disk-like light conducting sections extend substantially perpendicular to the sagittal plane. In one embodiment, the light conducting sections run adjacent to one another. The specified main reflection surface arches, starting from the light coupling surface, along the course toward the light decoupling surface in a convex manner, and is perpendicular on the extension surface of the light conducting section. The main reflection surface runs perpendicular to the meridional plane of the light module. The main reflection surface of the light conducting section is convex in sections with, or parallel to, the meridional plane, and has a parabolic or arc-segment course. The main reflection surface is a section of a cylindrical paraboloid, which is substantially without a curvature in sections with or parallel to the sagittal plane.

The primary lens element defines a primary focal line in that light, starting from the primary focal line, diverging in a section perpendicular to the primary focal line, can be converted to a light bundle that has been parallelized, passing through the light decoupling surface, at least in a plane perpendicular to the primary focal line. The convex curved main reflection surface, in particular, contributes to this. This is shaped, in particular, such that the optical path of the light (thus the combined product of the penetrated pathway length and refraction index of the respective spatial region through which the light beam passes) is constant for all light paths, starting from the primary focal line, through the respective light conducting section to the light decoupling surface.

The light module according to the invention exhibits, on the whole, a high degree of optical efficiency. Various features contribute to this. Because a common secondary lens element is provided, materials can be reduced in comparison with the known light module of the type specified in the introduction, and the light emitting section of the light module can be designed to be small. This enables a high degree of light density. Furthermore, each semiconductor light source is allocated to a light coupling surface. This can be designed such that it is adjusted in a manner allowing a high portion of the light emitted from the semiconductor light source to be accommodated. The disk-like light conducting sections with the shared secondary lens element enable a compact assembly.

In one embodiment, the numerous light conducting sections are connected to one another to form a single unit in the region of the light decoupling surfaces. In particular, the light conducting sections extend such that they run adjacent to one another and open into a shared decoupling section of the primary lens element. The light decoupling surfaces are disposed on the decoupling section. The decoupling section can exhibit a common light decoupling surface for all of the light conducting sections. The light conducting sections may be connected to one another to form a single unit and, if applicable, are connected to the decoupling section.

It is also, however, conceivable that the light conducting sections run adjacent to one another, and the light decoupling surfaces are disposed at a spacing to one another. The light conducting sections need not be connected to one another to form a single unit. Preferably, the light decoupling sections of different light conducting sections lie in a common virtual plane.

In the region of the light coupling surfaces, in contrast, the light conducting sections may be spaced apart from one another. As a result, the semiconductor light sources can be disposed at a sufficient spacing in order to ensure a sufficient heat discharge.

Each light conducting section is bordered by other light conducting surfaces. These are perpendicular to the sagittal plane, and thus form the lateral surfaces of the light conducting sections that border the light conducting section along its flat expansion.

The specified further light conducting sections run such that the light conducting section is perpendicular to the sagittal plane in sections, and exhibits a rectangular shape in relation to the meridional plane. If the lateral surfaces, in contrast, are at an angle to the sagittal plane, then, with total reflection at such lateral surfaces, the light beams receive a directional component that is perpendicular to the sagittal plane. This can, depending on the application, be undesired, in that light beams can, for example, be deflected into the dark region of a low beam light distribution as a result.

The other light conducting sections can be designed such that the cross-section of the light conducting section increases in the course from the light coupling surface to the light decoupling surface. With multiple total reflections at the lateral walls, light beams then meet on the lateral surfaces with each total reflection at a lower angle than was the case with the previous total reflection. As a result, a collimation of the light can be obtained. It is also conceivable that the further light conducting surfaces run such that the cross-section of the light conducting section decreases, starting from the light coupling surface, toward the light decoupling surface. As a result, an additional light diversification can be obtained.

The other specified light conducting surfaces of individual light conducting sections can also be curved, where they are, in particular, perpendicular to the sagittal plane. The curvature is, in particular, such that the entire light conducting section runs in sections parallel to the sagittal plane, in a curve. This design is advantageous if numerous light conducting sections are to be combined to form a common light decoupling surface or a common decoupling section. In this case, the light conducting sections at the edges, for example, can be curved. In this way, a sufficient spacing between the semiconductor light sources can be maintained.

The light conducting section can furthermore (in each case) exhibit a counter-reflection surface opposite the curved main reflection surface. The counter-reflection surface is substantially flat or (in comparison with the main reflection surface) only curved to a limited degree. The counter-reflection surface forms a narrow side of the disk-like light conducting section. By reflecting on the counter-reflection surface, the light beams guided to the light conducting surface receive a directional component toward the main reflection surface after being reflected on the main reflection surface. This enables a change in the main beam direction of the light module with a suitable orientation of the counter-reflection surface.

The secondary lens element may be shaped such that a secondary focal line is defined. This is distinguished in that a virtual, starting from the secondary focal line, diverging light bundle can be converted to a parallelized light bundle, perpendicular to the secondary focal line in sections. The secondary focal line runs perpendicular to one or all of the primary focal lines. In one embodiment, secondary focal lines and primary focal lines are oriented perpendicular to the main beam direction of the light module. Because the secondary focal line and the primary focal line are perpendicular to one another, the light concentration is functionally divided onto two successive components in the beam path. The secondary lens element functions only to concentrate light in sections parallel to the sagittal plane. The primary lens element, in contrast, is designed such that a light concentration occurs substantially only in sections perpendicular to the sagittal plane or in sections parallel to, or in the meridional plane. A light bundle passing through the secondary lens element remains unaffected in sections perpendicular to the sagittal plane.

The light decoupling surfaces of the light conducting sections lie between the secondary focal line and the secondary lens element. The secondary focal line lies in the opposite direction of the main beam direction of the light module, behind the light decoupling surfaces. With this design, a light bundle, diverging starting at the light decoupling surface, is not parallelized, but only constricted. It is, however, conceivable that the secondary focal line runs on at least one light decoupling surface.

The main reflection surface of one or all of the light conducting sections can, in each case, exhibit one or more facets for light scattering. A facet is formed, for example, by a region of the main reflection surface, which is tilted, skewed, recessed or elevated, locally in relation to the surrounding regions of the main reflection surface. In particular, the facet is designed such that the main reflection surface exhibits a local discontinuous or broken (i.e. not continuously differentiable) course. As a result, a light bundle can be deflected to a direction deviating from the remaining light bundles passing through the light decoupling surface. By way of example, a light bundle can be directed specifically to the dark region above the light/dark border. With this "overhead lighting" it is then possible to illuminate street signs. With a correspondingly smaller expansion of the facet, only a more limited portion of the light is deflected to the dark region, such that a hazardous blinding of oncoming traffic can be avoided.

In one embodiment, each semiconductor light source (each having one or more LEDs) includes at least one flat light emitting surface, which is bordered by at least one straight boundary edge. This boundary edge can run on the primary focal line of the allocated light conducting section. It is, however, also conceivable that the primary focal line of the allocated light conducting section runs through the light emitting surface.

The boundary edge can be an edge of the optically active semiconductor surface. It is, however, also conceivable, that a shutter having a shutter edge is provided, wherein the shutter edge defines the specified boundary edge of the semiconductor light source.

The light beam distribution of the light module is substantially affected by the position of the light emitting surface and the boundary edge in relation to the primary focal line. If the boundary edge runs on the primary focal line, the light distribution passing through the decoupling surface of the allocated light conducting section exhibits a light/dark border. This is substantially obtained through a mapping of the boundary edge. Depending on the direction in which the light emitting surface extends, starting from the primary focal line, the light beam distribution exhibits an upper dark region (e.g. for a low beam distribution) or a lower dark region (e.g. for a high beam/spot distribution).

The light module according to the invention enables, for various light conducting sections, a selection of different configurations of the semiconductor light sources in relation to the primary focal line. This can occur, on one hand, in that for various light conducting sections, the primary focal line runs at different spacings to the respective light coupling surfaces (i.e. different primary focal lengths are selected). On the other hand, the respective semiconductor light sources can be disposed at different spacings to the allocated light coupling surfaces in the light module.

By way of example, a first semiconductor light source or a first group of semiconductor light sources can each be disposed such that the primary focal line of the respective allocated light conducting section runs on the boundary edge of the respective light emitting surface. A second semiconductor light source, or a second group of semiconductor light sources, can be disposed such that the primary focal line runs through the light emitting surfaces. In this case, the first semiconductor light source, or the first group of semiconductor light sources, respectively, form a low beam light source, for example, while in contrast, the second semiconductor light source, or the second group of semiconductor light sources, respectively, form a high beam light source. The different semiconductor light sources are typically electronically controllable, independently of one another, such that, for example, a high beam can be selectively turned on.

The light coupling surfaces are designed to be flat and tilted in relation to the likewise flat light emitting surfaces such that, between the light coupling surface and the light decoupling surface, a spacing gap is formed, having a varying size over the course of the light emitting surface. The spacing gap increases continuously over the course of the light emitting surface, starting from the primary focal line. In one embodiment, a conical gap is formed. A curved course of the light coupling surface can also be advantageous. A concave course can, for example, lead to a coupling of a larger quantity of light. A convex light coupling surface can be advantageous for limiting the divergence of the light bundle after coupling, and for adjusting the characteristics of the coupled light bundle to the numerical aperture of the light conducting section.

It is, however, also conceivable that the light coupling surface and the light emitting surface are both designed to be flat, and extend parallel to one another. The spacing gap then has a constant width.

The light decoupling surfaces of the light conducting sections extend perpendicular to the sagittal plane, in particular, such that they are also perpendicular to the main beam direction of the light module. The light decoupling surfaces are designed to be flat, for example, and are perpendicular to the main beam direction and the sagittal plane. It is also conceivable that the light decoupling surfaces are curved, in particular, such that they are convex. In this case, they exhibit a convex curvature, for example, in sections parallel to the sagittal plane, and, are not curved in sections perpendicular to the sagittal plane.

The secondary lens element is designed as a cylindrical lens for concentrating light in sections parallel to the sagittal plane. The cylindrical lens has a converging lens cross-section, for example, in sections in, or parallel to, the sagittal plane, and is without curvature in sections perpendicular to the sagittal plane. To this extent, the cylindrical lens can have a cylinder axis allocated to it, about which the light passage surfaces of the cylindrical lens are curved. The light passage surfaces refer to the optically effective surfaces of the cylindrical lens here, where light enters the lens, or is emitted therefrom.

The cylindrical lens can exhibit scattering structures on one or both of its light passage surfaces. These are designed in the manner of drums, wherein the drum axes of the scattering structures run parallel to the cylinder axis of the cylindrical lens. Although scattering structures of this type act against a bundling effect of the cylindrical lens, they lead, however, to a homogenous illumination of the light emitting section.

A particularly simple production of a compact light module is enabled in that the cylindrical lens is connected to form a single unit with the light conducting sections of the primary lens element. This is obtained in that the light decoupling surfaces of the light conducting section converge with one of the light passage surface of the cylindrical lens. To this extent, the cylindrical lens and the light conducting section are connected as a single unit with the light decoupling surfaces and a light passage surface. This enables the entire lens system of the light module to be designed as a single molded part.

The light conducting sections and the cylindrical lenses, as well as, if applicable, the shared decoupling section of the primary lens element, can be made of glass or plastic. Suitable plastics are, in particular, organic glasses, polycarbonate (PC), poly methyl methacrylate, cyclic olefin polymer (COP), cyclic olefin copolymer (COC), poly methyl methylamide (PMMI), or polysulfones (PSU). The specified plastics can be processed, in particular, in an injection molding procedure.

Another embodiment of the invention includes the secondary lens element being designed as a cylindrical reflector. This is designed as a section or segment of a cylindrical hollow mirror or a cylindrical parabolic mirror. The cylindrical reflector exhibits, for example, a parabolic curvature in the sagittal plane, and is designed to be without a curvature in sections perpendicular, in particular, to the sagittal plane. Because a cylindrical reflector light can not only concentrate or bundle, but can also deflect through reflection, the main beam direction of the light module can be structurally dictated with the specified structure. Furthermore, it is possible to prevent color aberrations that sometimes occur with the lenses, for example, which can lead to undesired color edges in the light beam distribution of the light module. The cylindrical reflector can exhibit scattering structures and/or facets, in order to obtain a more homogenous light beam distribution. Drum-like scattering structures are conceivable, for example, the drum axes of which run parallel to the cylinder axis of the cylindrical reflector.

BRIEF DESCRIPTION OF THE DRAWINGS

Further details and advantageous designs of the invention are to be derived from the following description, based on which the embodiments of the invention depicted in the figures are described and explained in greater detail.

DETAILED DESCRIPTION OF THE EMBODIMENTS OF THE INVENTION

In the following description, identical or corresponding components are provided with the same reference symbols. Information regarding the spatial positions of various components shall be provided in the following based on various planes in space. In explanation of the planes, FIG. 1 shows details of a light module 10, wherein the design features shown can be used in all of the light modules according to the invention.

Figure 1:
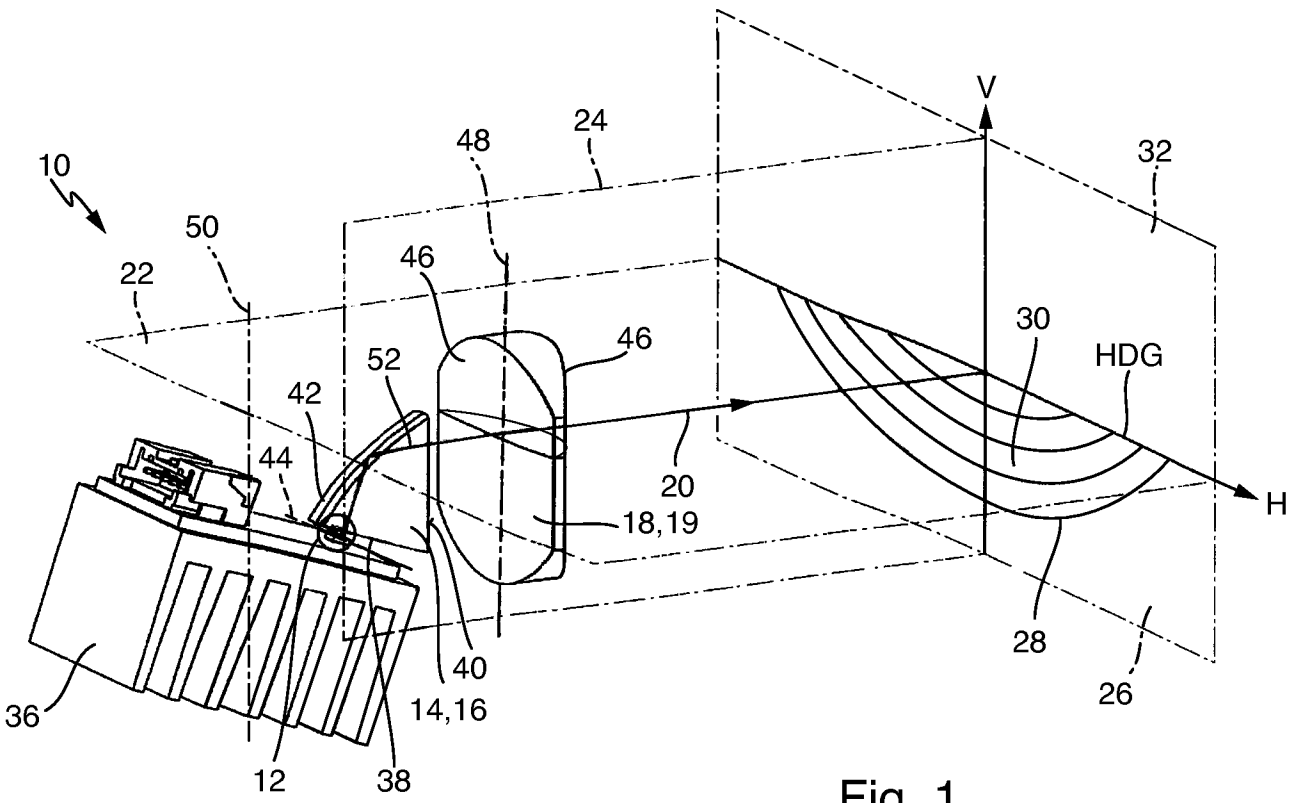
FIG. 1 illustrates a light module for explaining the geometry and design features.

A semiconductor light source 12, a disk-like light conducting section 14, as part of a primary lens element, as well as a secondary lens element 18, designed as a cylindrical lens 19, are shown in FIG. 1. For the light module, a main beam direction 20 is defined, in which the light energy is emitted in the spatial center thereof. Furthermore, a sagittal plane 22 is defined, which spans the horizontal plane and the main beam direction 20 in the depicted example. Moreover, a meridional plane 24 is defined as that plane extending perpendicular to the sagittal plane 22, and is spanned by the vertical plane as well as the main beam direction 20.

When the light module 10 is in operation, the intensity distribution of the light beam distribution 28 can be observed on a test screen 26. The test screen 26 extends in the plane perpendicular to the main beam direction 20 (i.e. both perpendicular to the sagittal plane 22 as well as to the meridional plane 24) and is disposed at a great distance from the light module in the direction of the main beam direction 20. The spatial position of regions of the light beam distribution 28 is indicated on the test screen 26 using vertical and horizontal angular coordinates V, H. These angular coordinates V, H correspond to coordinates spanned by the Cartesian coordinate system in the horizontal and vertical axes in the plane of the test screen 26.

In the depicted example, the light beam distribution 28 exhibits a light/dark border HDG, separating a lower vertical light region 30 and an upper vertical dark region 32 from one another. A light beam distribution 28 of this type is used in vehicle headlights as a low beam light distribution.

An LED chip of the semiconductor light source 12 can be discerned in FIG. 1, which can include more LED chips. The LED chip of the semiconductor light source 12 shown therein is disposed on a cooling element 36, in order to discharge the exhaust heat from the LEDs.

Of the primary lens element, only the disk-like light conducting section 14 is depicted, which extends in a plane perpendicular to the sagittal plane 22. The light conducting section 14 exhibits a measured thickness perpendicular to its plane of extension, which is substantially smaller than the dimensions of the light conducting section 14 in its plane of extension. The light conducting section 14 has a light coupling surface 38 facing the semiconductor light source 12, through which light in the light conducting section 14 can be coupled. The light coupled in this manner can be conducted to a light decoupling surface 40 in the light conducting section 14, subjected to internal total reflection, through which the light from the light conducting section 14 can be emitted. The internal reflection occurs thereby at a main reflection surface 42. In the depicted example, the main reflection surface 42 extends from the light coupling surface 38 to the light decoupling surface 40.

The main reflection surface 42 is convex in relation to the sagittal plane 22, such that the optical properties of the light conducting section 14 can be characterized by a primary focal line 44. This is distinguished in that a virtual light cluster, diverging from the primary focal line in a section perpendicular to the primary focal line 44 is deflected, after passing through the light coupling surface 38 and total reflection on at least the main reflection surface 42, in a light cluster passing through the light decoupling surface 40, which consists substantially of parallel light beams in a section perpendicular to the sagittal plane 22. To this extent, the light conducting section 14 functions in a collimating manner in sections perpendicular to the sagittal plane 22.

The secondary lens element 18 is designed as a cylindrical lens 19, the optically effective light passage surfaces 46 of which are curved cylindrically about a cylinder axis 48. In sections parallel to the sagittal plane 22, the cylindrical lens 19 exhibits, in each case, a convergent lens cross-section. In sections perpendicular to the sagittal plane 22, the cylindrical lens 18 has a course free of curvature. The optical properties of the cylindrical lens 19 are characterized by, among other things, a secondary focal line 50. This is distinguished in that, starting from the secondary focal line, a virtual light cluster, diverging in sections perpendicular to the secondary focal line 50, is converted to a light cluster consisting substantially of parallel light beams in sections parallel to the sagittal plane 22 after passing through the cylinder axis 19. The secondary lens element 18 functions thereby in a collimating manner in sections parallel to the sagittal plane 22.

The secondary lens element 18 and the primary lens element 16 are disposed in relation to one another such that the secondary focal line 50 runs perpendicular to the primary focal line 44. It can be advantageous for all of the light modules according to the invention if the primary focal line 44 runs between the secondary focal line 50 and the secondary lens element 18. The focal length allocated to the cylindrical lens 18 is, e.g. selected to be large enough that the secondary focal line 50 is offset, in relation to the light decoupling surface 40 of the light conducting surface 12, in the opposite direction of the main beam direction 20. The secondary lens element 18 thus does not function in a collimating manner, but rather, merely narrows light bundles in sections parallel to the sagittal plane 22. It is, however, also conceivable that a shorter focal length be selected for the cylindrical lens 19, such that the secondary focal line 50 runs closer to the cylindrical lens 19, e.g. between the primary focal line 44 and the cylindrical lens 19, or in the region of, or on, the light decoupling surface 40.

In the case depicted in FIG. 1, the light decoupling surface 40 runs perpendicular to the sagittal plane 22 and perpendicular to the meridional plane 24. The light conducting section 14 is mirror symmetric to the meridional plane 24 in the depicted example. Likewise, the cylindrical lens 19 is mirror symmetric in relation to the meridional plane 24. The secondary focal line 50 runs in the meridional plane 24.

By way of explanation for the beam path, a main beam 52 is illustrated in FIG. 1, which falls on the light/dark border HDG after passing through the secondary lens element 18 along the main beam direction 20. The main beam 52 runs in the meridional plane 24. Starting from the primary focal line 44, the main beam 52 passes through the light coupling surface 38 in the light conducting section 14, is totally reflected at the convex main reflection surface 42, and passes through the light decoupling surface 40 and out of the light conducting section 14. Subsequently, the main beam 52 runs in the meridional plane 24, parallel to the sagittal plane 22. Because the main beam 52 has no directional component perpendicular to the meridional plane 24, its course is not affected by the cylindrical lens 19 (in the depicted example). The main beam 52 therefore runs, after the cylindrical lens 19, in the meridional plane 24, and perpendicular to the sagittal plane 22, along the main beam direction 20.

The design features of the light module 10 illustrated in FIG. 1, in particular the light conducting section 14 and the secondary lens element 18, may be used for all light modules according to the invention. Likewise, by way of explanation for other embodiments of the invention, reference is made to the sagittal plane 22, the meridional plane 24, the test screen 15 and the main beam direction 20, as defined according to FIG. 1.

Figure 2:
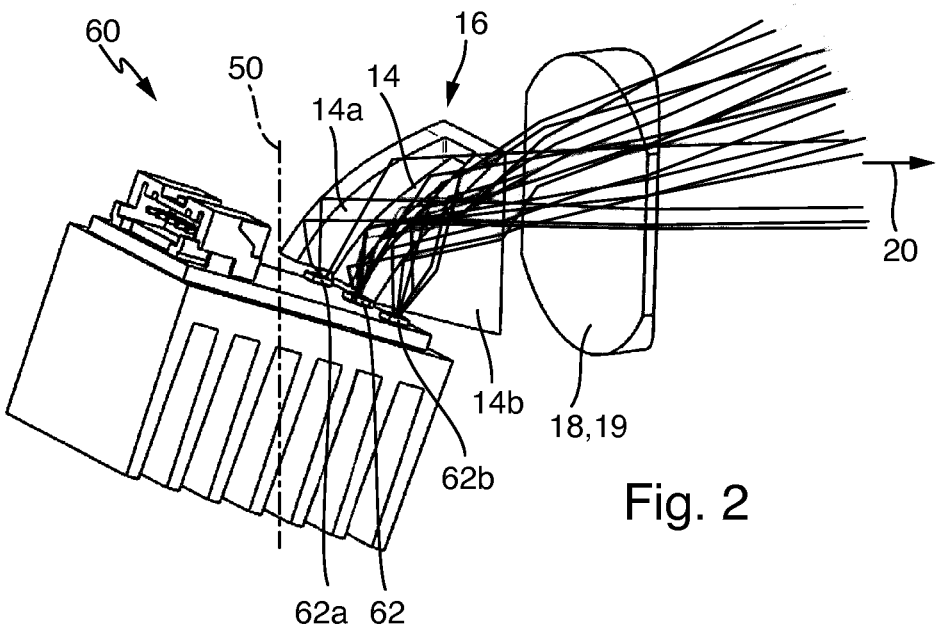
FIG. 2 illustrates a light module according to the invention in a perspective depiction.
Figure 3:
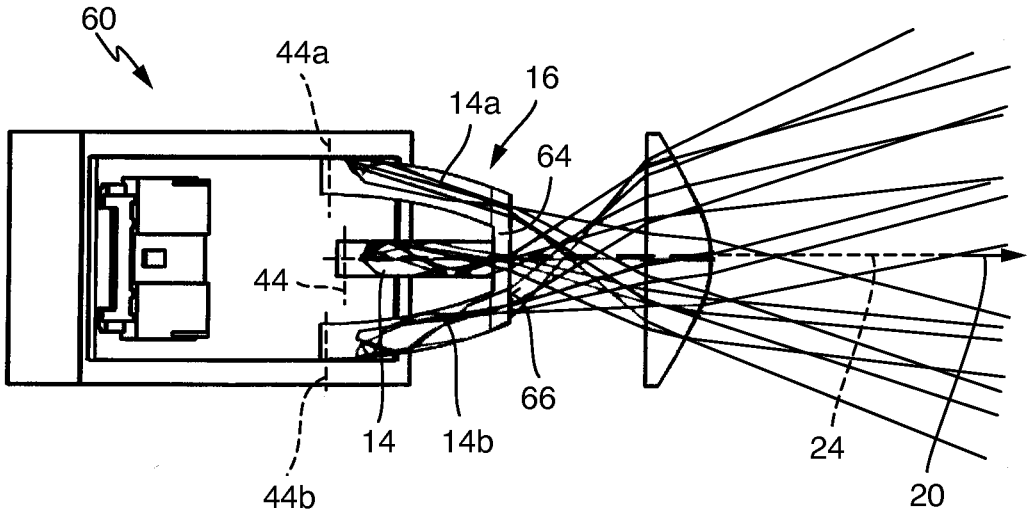
FIG. 3 illustrates the light module from FIG. 2 in a top view.

A light module 60 according to the invention is depicted in FIGS. 2 and 3. The primary lens element 16 of the light module 60 includes three light conducting sections 14, 14*a*, 14*b*, as well as a secondary lens element 18, designed as a cylindrical lens 19, in the manner illustrated in FIG. 1.

Each light conducting section 14, 14*a*, 14*b* is allocated to a substrate 62, 62*a*, 62*b* (LED chip) in the form of a semiconductor light source, such that the light emitted from the respective substrate 62, 62*a*, 62*b* can be coupled by respective allocated light coupling surfaces in the respective light conducting section 14, 14*a*, 14*b*.

The three light conducting sections 14, 14*a*, 14*b* run adjacent to one another and extend in each case perpendicular to the sagittal plane 22 (FIG. 1). In doing so, the middle light conducting section 14 is designed in the manner illustrated in FIG. 1. The two outer light conducting sections 14*a*, 14*b* run in curves in sections parallel to the sagittal plane 22 (FIG. 1), which shall be explained in greater detail in the following, particularly in reference to FIG. 12.

The light conducting sections 14, 14*a*, 14*b* run such that they open into a shared decoupling section 64 of the primary lens element 16 (FIG. 3). The decoupling section 64 exhibits a shared light decoupling surface 66, which includes the light decoupling surfaces 40 of the light conducting sections 14, 14*a*, 14*b* as defined in FIG. 1. It is conceivable that the decoupling section 64 may be formed as a single unit with the light conducting sections 14, 14*a*, 14*b*.

In deviating from the design described above, it is also conceivable that each light conducting section 14, 14*a*, 14*b* exhibits a separate light decoupling surface 40 in the manner of FIG. 1, where the light conducting sections 14, 14*a*, 14*b* open into the decoupling section 64 (e.g. in a form not being a single unit). Materials having different optical properties (e.g. refraction index), for example, than that selected for the light conducting sections 14, 14*a*, 14*b*, can then be selected for the decoupling section 64. The transition between the light conducting sections 14, 14*a*, 14*b* and the decoupling section 64 is indicated in FIG. 3 by lines. It is not, however, necessary that separate components be used.

As shown in FIG. 3, each light conducting section 14, 14*a*, 14*b* is allocated a primary focal line 44, 44*a*, 44*b*. The primary focal lines 44, 44*a*, 44*b* each run in the sagittal plane 22 (cf. FIG. 1). In their direction of extension along the main beam direction 20, the light conducting sections 14, 14*a*, 14*b* exhibit different lengths. The allocated primary focal lines 44, 44*a*, 44*b* do not run along a common, virtual line in the light module 60. Rather, the primary focal line 44 is offset in relation to the primary focal lines 44*a*, 44*b* in the direction of the main beam direction 20. Fundamentally, each of the light conducting sections 14, 14*a*, 14*b* can be designed such that a desired focal length and thus a desired course of the respective allocated primary focal lines 44, 44*a*, 44*b* is obtained. Different light conducting sections 14, 14*a*, 14*b* can have different focal lengths allocated to them, such that different light functions (low beams, high beams, daytime running lights) can be implemented with the different light conducting sections 14, 14*a*, 14*b*.

It is likewise conceivable that the substrates 62, 62*a*, 62*b* are disposed in each case in different positions in relation to the primary focal lines 44, 44*a*, 44*b* of their respective allocated light conducting sections 14, 14*a*, 14*b*.

With the light module 60, the secondary lens element 18, disposed downstream of the primary lens element 16 in the beam path, functions collectively for all of the light conducting sections 14, 14*a*, 14*b* in the manner illustrated in FIG. 1. The secondary focal line 50 extends perpendicular to all of the primary focal lines 44, 44*a*, 44*b*.

In the case presented in FIGS. 2 and 3, the primary lens element, which includes numerous light conducting sections 14, 14*a*, 14*b* is designed to be mirror symmetrical to the meridional plane 24 (having the position illustrated in FIG. 3. The configuration and design of the individual semiconductor light sources 62, 62*a*, 62*b* is also mirror symmetrical to the meridional plane 24 as a whole. Because the cylinder axis 19 is also designed to be mirror symmetrical to the meridional plane 24, the meridional plane 24 represents a plane of symmetry for the entire lens system.

Figure 4:
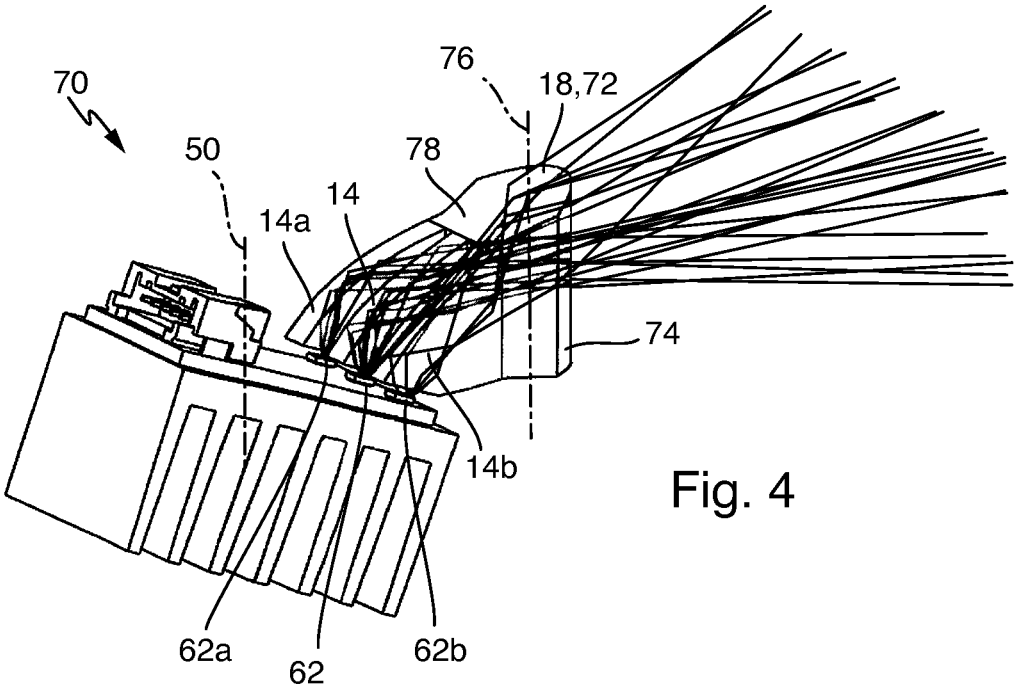
FIG. 4 illustrates another embodiment of a light module according to the invention in a perspective depiction.
Figure 5:
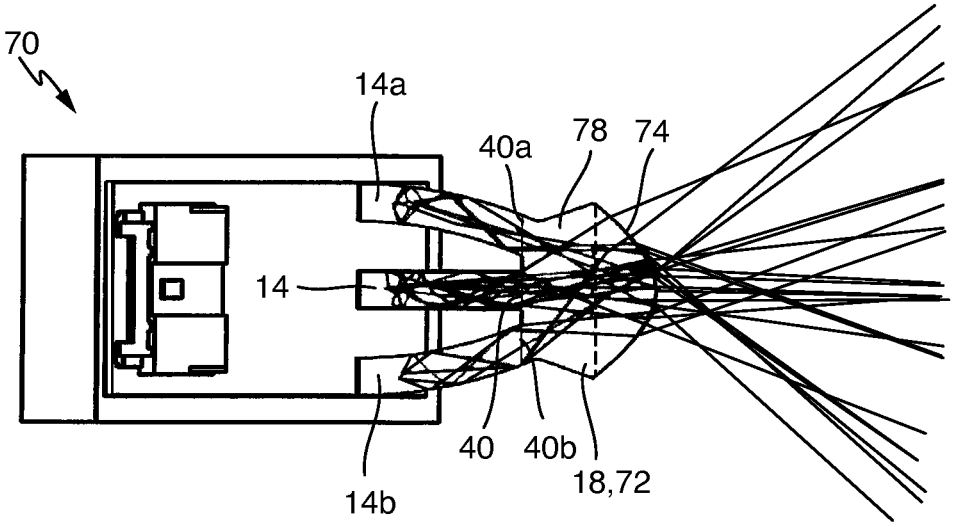
FIG. 5 illustrates the light module from FIG. 4 in a top view.

A light module 70 is depicted in FIGS. 4 and 5. This differs from the light module 60 in that the three light conducting sections 14, 14*a*, 14*b* open directly into the shared secondary lens element 18.

The secondary lens element 18 is designed as a cylindrical lens element 72, having a cylinder lens surface 74. The cylinder lens surface 74 is curved in a cylindrical manner about a cylinder axis 76 running perpendicular to the sagittal plane 22 (FIG. 1) and the main beam direction 20. The lens element 72 also exhibits a transition section 78, into which the light conducting sections 14, 14*a*, 14*b* of the primary lens element 16 open.

The light conducting sections 14, 14*a*, 14*b* are connected to the transition section 78 of the lens element 72, via their light decoupling surfaces 40, 40*a*, 40*b* (see FIG. 1 by way of explanation), such that light passing through the light decoupling surfaces 40, 40*a*, 40*b* arrives in the lens element 72, and is refracted upon passing through the cylindrical lens surface 74. Due to the cylindrical shape of the cylindrical lens surface 74, the lens element 72 can, in turn, have a primary focal line 50 allocated to it, having the previously described properties.

The lens element 72 is connected as a single unit to the light conducting sections 14, 14*a*, 14*b*, via the light decoupling surfaces 40, 40*a*, 40*b*. The connection is such, in particular, that light beams arrive un-refracted in the lens element 72, at the transition from a light conducting section 14, 14*a*, 14*b*, through the (virtual) light decoupling surfaces 40, 40*a*, 40*b*. The unit having the light conducting sections 14, 14*a*, 14*b* forming the primary lens element 60, and the lens element 72 forming the secondary lens element 18 can be manufactured from a suitable plastic as a single-piece molded component, for example, in injection molding processes.

It is also conceivable, starting from the light module 60 depicted in FIGS. 2 and 3, to generate a single piece design in that the decoupling section 64 is connected as a single piece, with its light decoupling surface 66, to a light passage surface 46 of the cylindrical lens 19 in accordance with FIGS. 2 and 3.

With the light modules according to the invention, the properties of the light beam distribution 28 are substantially determined by the configuration of the semiconductor light sources 12 in relation to the respective allocated primary focal line 44, which shall be explained below based on FIG. 6.

Light emitting diodes (LED) are preferably used as the semiconductor light sources 12, 62, having a light emitting surface 80, which is sharply confined by straight boundary edges 82. LEDs having square light emitting surfaces 80 and corresponding boundary edges 82 are typical. Numerous LEDS are disposed on a common substrate 62, and from a semiconductor light source 12.

In FIG. 6, such semiconductor light sources 12 are illustrated, in each case, wherein three possible courses for the allocated primary focal line 44 of the light conducting section 14 are indicated, when the semiconductor light source 12 is installed in a light module of the present typed. For this, the plane for the light emitting surfaces 80 is defined in a forward direction 84 (for example, substantially in the direction of the main beam direction 20) and a backward direction 85 (for example, in the direction opposite of the main beam direction 20).

Figure 6A:
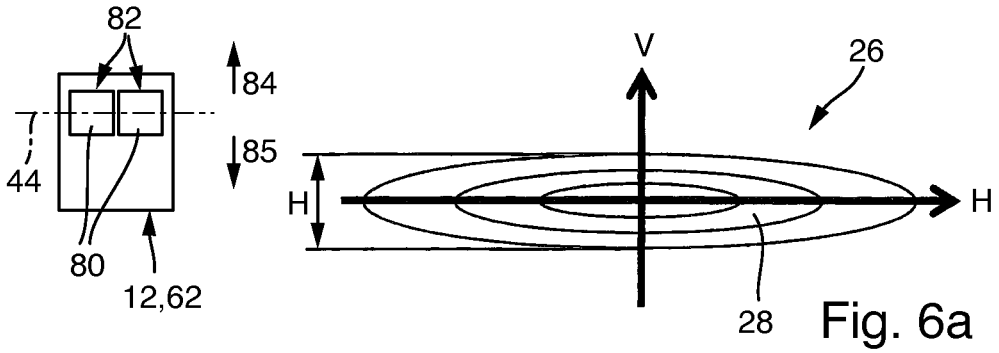
FIGS. 6*a*, 6*b* and 6*c* illustrate the configuration of the semiconductor light sources.

In the case presented in FIG. 6*a*, the semiconductor light source 12 is disposed such that the allocated primary focal line 44 passes through the light emitting surfaces 80. The lighting pattern depicted in FIG. 6*a* to the right of the drawing of the semiconductor light source 12 is obtained for the light beam distribution 28 observed on a test screen 26 (cf. FIG. 1).

The light conducting section 14 parallelizes diverging light bundles in sections perpendicular to the primary focal line 14, starting from the primary focal line 44. Because the light emitting surface 80 extends both in the forward direction 84 as well in the backward direction 85, starting from the primary focal line 44, light beams exhibiting a directional component that runs vertically upward, as well as light beams having a directional component that runs vertically downward, pass through the light decoupling surfaces and through the secondary lens element 18. As a result, the light beam distribution 28 does not exhibit a light/dark border, but instead, has the properties of a spot light distribution, with a light focal point surrounding the main beam direction (provided, for example, by the main beam 52 illustrated in FIG. 1).

Figure 6B:
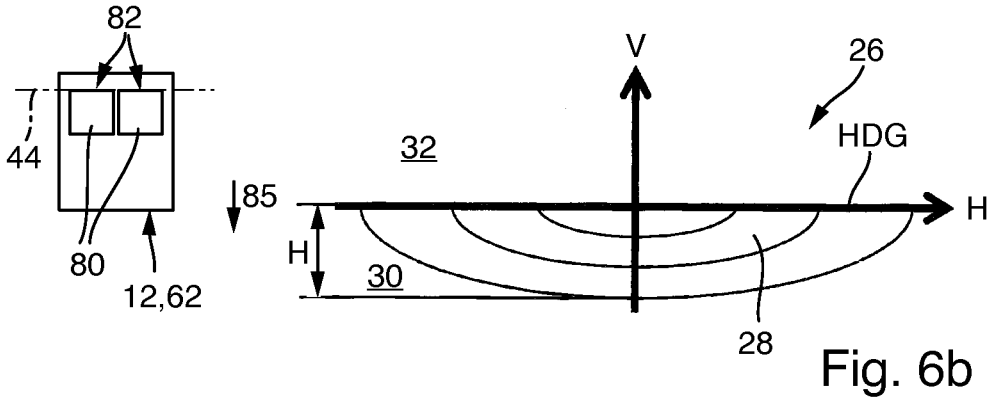

In the case presented in FIG. 6*b*, one boundary edge 82 for each light emitting surface 80 runs along the primary focal line 44. Starting from the primary focal line 44, the light emitting surface 80 extends backward 85. The light beams starting from the specified boundary edges 82 are parallelized in the main beam direction 20. This leads to a light/dark border HDG on the test screen 26, as is indicated in the drawing of the light beam distribution 28 to the right of the depiction of the chips 62 in FIG. 6*b*. The light beams, which originate from the light emitting surfaces extending backward 85, exhibit a vertically downward directional component after passing through the light decoupling surface 40, or through the secondary lens element 18, respectively. As a result, the light beam distribution 28 exhibits a vertically downward lying light region 30, and a vertically upward lying dark region 32, separated therefrom by the light/dark border HDG.

Figure 6C:
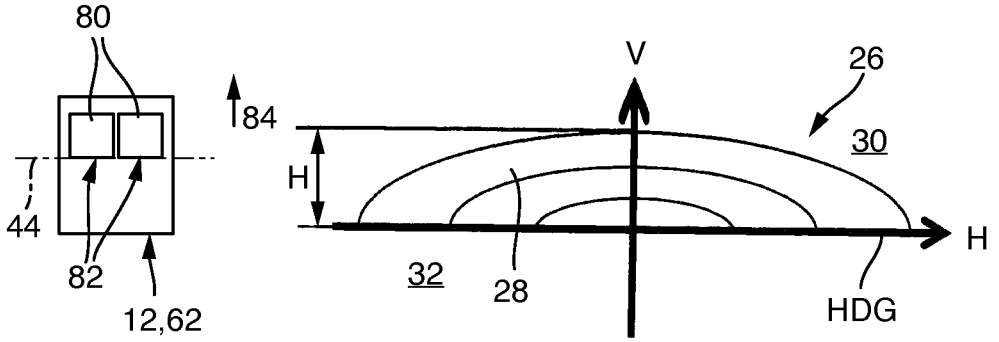

In the example in FIG. 6*c*, the light emitting surface 80 extends in the forward direction 84, starting from the primary focal line 44. In doing so, the primary focal line 44 runs through one boundary edge 82 of each light emitting surface 80. Accordingly, the light beams emitted from the boundary edges 82 lying on the primary focal line 44 lead, in turn, to a sharp light/dark border HDG, wherein, in this case, the light region 30 lies vertically above the dark region 32 (drawn on the right-hand side of FIG. 6*c*).

In the cases according to FIG. 6*b* and FIG. 6*c*, in each case a boundary edge 82, which runs on the primary focal line 44, is depicted as a light/dark border of the light beam distribution 28. The rest of the light emitting surface 80 is projected in a corresponding light source image via the light conducting section 14 and the secondary lens element 18. If the light emitting surface 80 is displaced in the forward direction 84 in relation to the primary focal line 44, then the position of the specified light source image is altered vertically on the test screen 26. For this, the light conducting section 14 is preferably designed such that, through the displacement, the dimensions of the respective light source images measured along the vertical direction v do not change.

Figure 7:
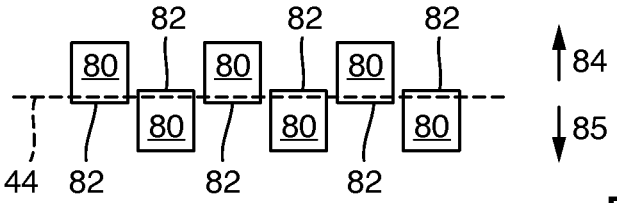
FIG. 7 illustrates the configuration of the semiconductor light sources.

Because the characteristics of the light beam distribution 28 depend, as explained, on the position of the semiconductor light source 12 in relation to the primary focal line 44, a multi-functional light module can be implemented in a simple manner with the configuration according to the invention. For this, multiple semiconductor light sources 12, for example, can be provided, wherein semiconductor light sources 12 of a first group are disposed in the manner shown in FIG. 6*b*. A second group can exhibit semiconductor light sources 12 that are disposed in the manner shown in FIG. 6*c*. This is illustrated in FIG. 7. The first group of semiconductor light sources then results in a light beam distribution having a light region lying vertically below, whereby the second group leads to a light beam distribution have a vertically upward lying light region (cf. FIG. 6). The specified first group can thus supply a low beam light distribution of a vehicle headlight, which exhibits a light/dark border running horizontally. The second group can serve as the high beam source, which leads to an illumination above the light/dark border.

In one embodiment, the semiconductor light sources in the first group can be electronically controlled independently of the semiconductor light sources in the second group. Specifically, they can be switched on and off. As a result, the high beam light distribution, for example, can be switched on in addition to the low beam light distribution, and off, as desired.

In order to obtain the most homogenous transition possible between the high beam illumination above the light/dark border and the base light distribution beneath the light/dark border, the light emitting surfaces 80 of the second group, for example, can be displaced such that the light emitting surfaces 80 slightly overlap the primary focal line 44.

For various light conducting sections 14, different configurations of the allocated semiconductor light sources 12 in relation to the respective primary focal line 44 may be selected. With different light conducting sections 14, different contributions to the light beam distribution can thus be implemented. It is, however, also conceivable to allocate a substrate 62 having numerous LEDs with light emitting surfaces 80 to a light conducting section 14, wherein different LEDs assume different positions in relation to the primary focal line 44 and the light conducting section 14 thereof.

Figure 8:
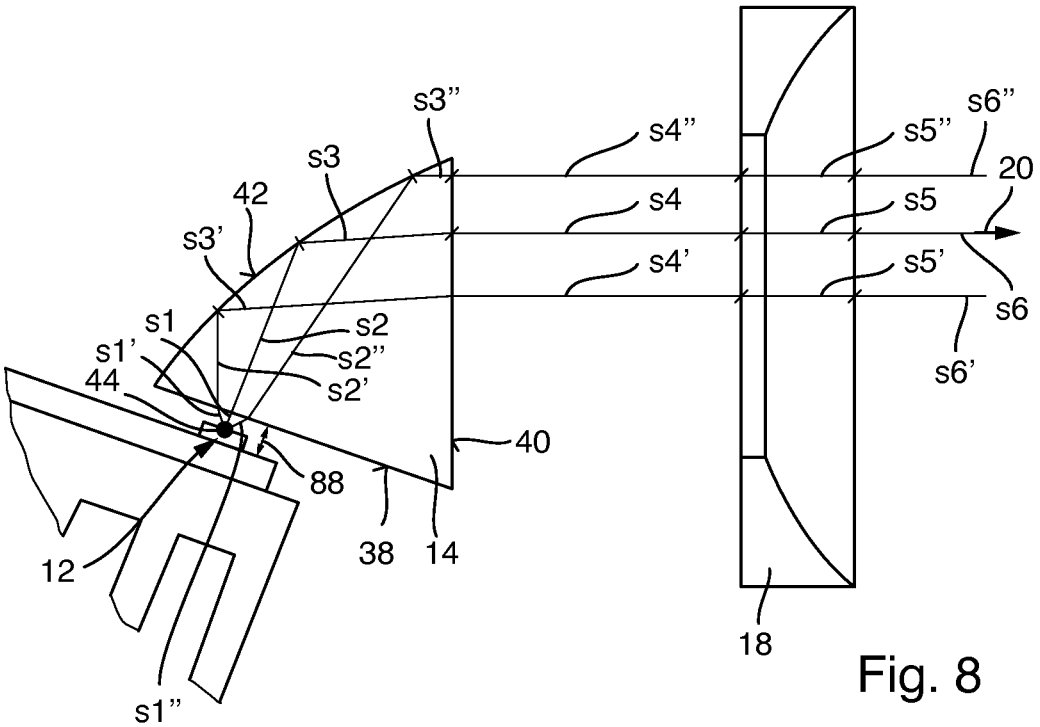
FIG. 8 illustrates a depiction of the beam path in the light modules according to the invention.

The optical properties of the light conducting section 14 of the light module according to the invention shall be explained further in the following based on FIG. 8. FIG. 8 shows a section cut through a light module according to the invention (light module 60, for example), wherein the cutting plane extends perpendicular to the sagittal plane 22.

In order to obtained the specified optical properties, the light conducting section 14 (in particular, the main reflection surface 42, the light coupling surface 38, and the light decoupling surface 40) are designed such that the optical path (in the projection perpendicular to the primary focal line 44) for all light beams starting from the primary focal line 44, passing through the light coupling surface 48, and reflected in total at the main reflection surface 42, are constant up until passing through the light decoupling surface 40 (as well as in the further course through the secondary lens element 18). The optical path is understood in the conventional manner to be the product of the respective allocated refraction index ni and the path si that has been traveled in the respective material section. The optical paths for three different beams in a plane perpendicular to the primary focal line 44 are depicted in FIG. 8. A first beam travels a path s1, starting from the primary focal line 44, as far as the light coupling surface 14, a path s2 in the light conducting section 14 as far as the main reflection surface 42, after total reflection, a path s3 through the light conducting section 14 as far as the light decoupling surface 40, following emission from the light conducting section 14, further path sections s4, s5 (through the secondary lens element 18) and s6. For this, the refraction index of the light conducting section 14 is decisive for the path sections s2 and s3, while in contrast, the path sections s1 and s4 run through air. Accordingly, two additional paths (s1', s2', s3', s4', s5', s6' and s1", s2", s3", s4", s5", s6"), which differ in terms of the position of the point of total reflection on the main reflection surface 42. The product s1 times n1 accumulated from the individual path sections is constant for the various paths.

In the example depicted in FIG. 8, the light conducting section 14 is a cylindrical wedge wherein the light coupling surface 38 forms an acute angle with the light decoupling surface 40. In the depicted example, the main reflection surface 42 extends from the light coupling surface 38 to the light decoupling surface 40. These designs are not, however, mandatory. It is conceivable, in particular, that the light coupling surface 38 and the light decoupling surface 40 form a right angle. If the light conducting section 14 exhibits further boundary surfaces, then the light coupling surface 38 and the light decoupling surface 40 can also run parallel, as is explained in greater detail below in reference to FIG. 15.

In the example in FIG. 8, the light coupling surface 38 extends substantially parallel to a light emitting surface of the semiconductor light source 12 (which, for example, is designed in the manner explained in reference to FIG. 6). As a result, a spacing gap 88 is formed between the light coupling surface 38 and the light emitting surface 80, exhibiting a constant size along the course of the light emitting surface of the semiconductor light source 12. Designs in which the light coupling surface 38 runs at an angle to the light emitting surface of the semiconductor light source 12, and thus, the spacing gap 88 exhibits a variable size over the course of the light emitting surface, are also, however, conceivable. Likewise, the light coupling surface 38 can be designed to be curved, for example, in a convex or concave manner, such that the size of the spacing gap 88 changes over the course of the light emitting surface of the semiconductor light source 12.

Designs for the light conducting section 14 shall be explained in the following in reference to FIGS. 9-14. These can be used with all of the light conducting sections of the light module according to the invention, wherein in FIGS. 9-14, only one single light conducting section 14 is shown in each case.

Figure 9:
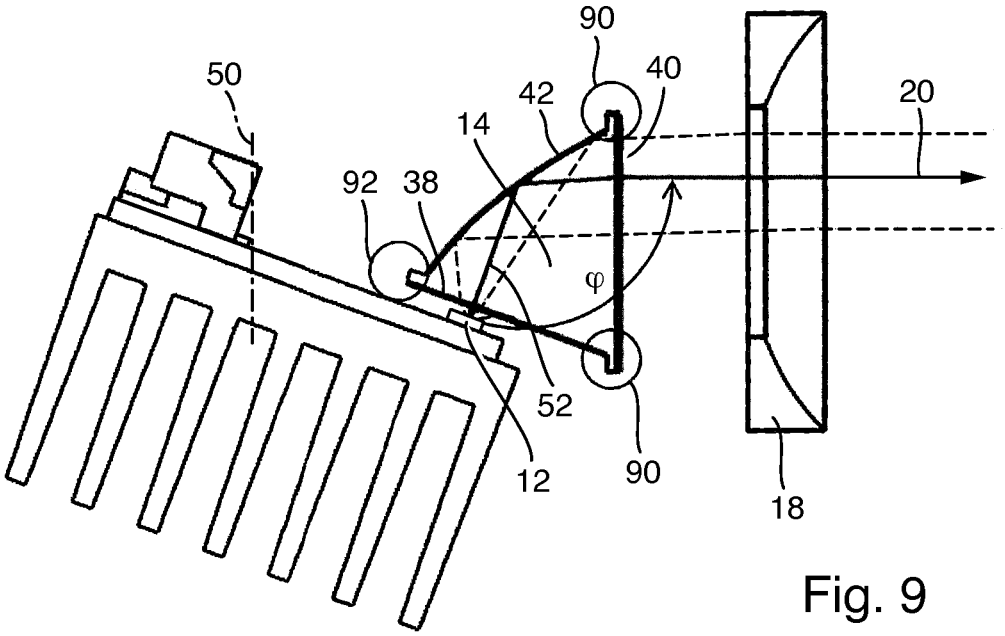
FIG. 9 through FIG. 14 illustrate depictions of the designs for the primary lens element.

As indicated in FIG. 9, not all of the boundary surfaces of a light conducting section 14 need function as lenses. In particular, the light conducting section 14 in the regions between the main reflection surface 42 and the light decoupling surface 40, or between the light coupling surface 38 and the light decoupling surface 40, or between the light coupling surface 38 and the main reflection surface 42, can exhibit sections that do not function as a lens, i.e. they have no substantial significance regarding the optical properties of the light conducting section 14. Thus, the light conducting section 14 can, for example, exhibit a flange-like lip 90 at the transitions of the light decoupling surface 40 to the main reflection surface 42 and to the light coupling surface 38. This can serve as an attachment section of the light conducting section 14. Likewise, an orientation having a precise positioning can be obtained via the flange-like lip 90. Accordingly, an attachment or positioning section 92 may be provided at the transition between the light coupling surface 38 and the main reflection surface 42. The attachment and positioning sections 90, 92 may be shaped during an injection molding step in the production of the light conducting section 14, as a single piece therewith.

The light conducting section 14 is bordered by further light conducting surfaces 94 and 96, which are perpendicular to the sagittal plane 22 (FIG. 1). The further light conducting surfaces 94 and 96 form, to this extent, large lateral surfaces of the light conducting section 14 extending in a plane, while, in contrast, the light coupling surface 38, the light decoupling surface 40 and the main reflection surface 42 represent narrow lateral surfaces of the disk-like light conducting section 14. With respect to the light transport through the light conducting section 14, the further light conducting surfaces 94 and 96 have the function of conducting light beams having directional components perpendicular to the main beam direction 20, subjected to total reflection from the light coupling surface 38, to the light decoupling surface 40.

Figure 10:
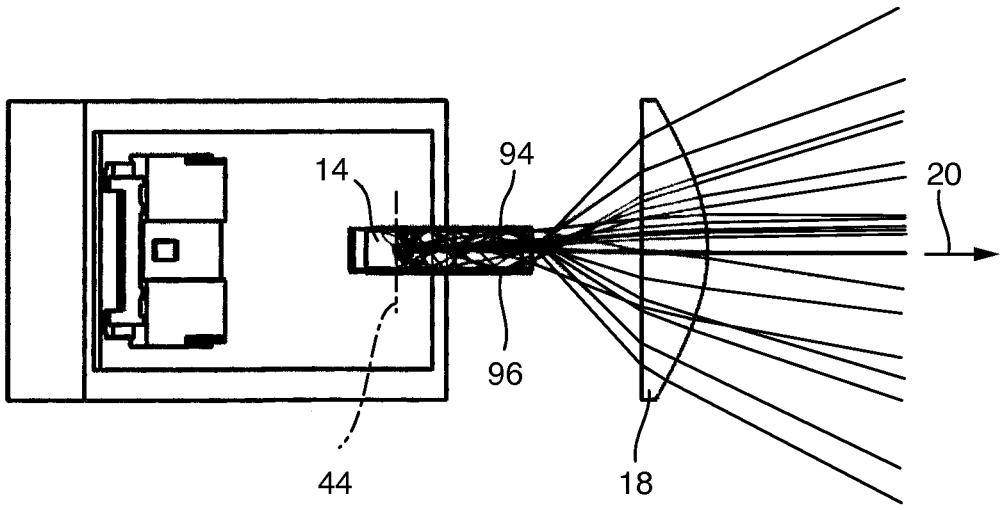

As is depicted in FIG. 10, the further light conducting surfaces 94 and 96 are, in particular, perpendicular to the sagittal plane 22 (plane of sight in FIG. 10) and may run parallel to one another.

Figure 11:
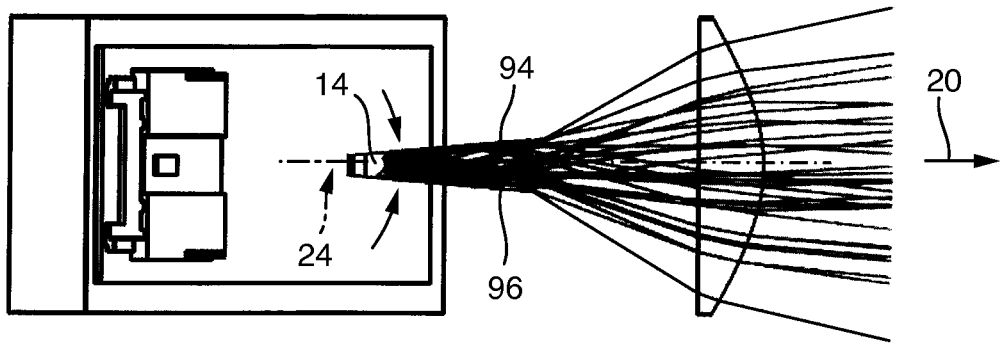

An alternative design is shown in FIG. 11. In this case, the further light conducting surfaces 94 and 96 are likewise perpendicular to the sagittal plane 22 (plane of sight in FIG. 11), but run, however, apart from one another in the direction of the main beam direction 20, such that the cross-section surface of the light conducting section 14 measured in sections perpendicular to the main beam direction 20 increases in size continuously as they advance in the direction of the main beam direction 20. In particular, the further light conducting surfaces 94 and 96 are designed to be flat, and form, together, an open, acute angle in the main beam direction 20. As a result, the light conducting section 14 has a trapezoidal shape in sections parallel to the sagittal plane 22 (plane of sight in FIG. 11). The further light conducting surfaces 94 and 96 thus run apart from one another in a conical manner. In the example in FIG. 11, the light conducting section 14 is designed to be mirror symmetrical to the meridional plane 24. It is also conceivable, however, that the light conducting section 14 is disposed such that it is offset in the direction perpendicular to the meridional plane, or that the light conducting surface 94 forms an (acute) angle with the main beam direction 20, different than that of the further light conducting surface 96.

Figure 12:
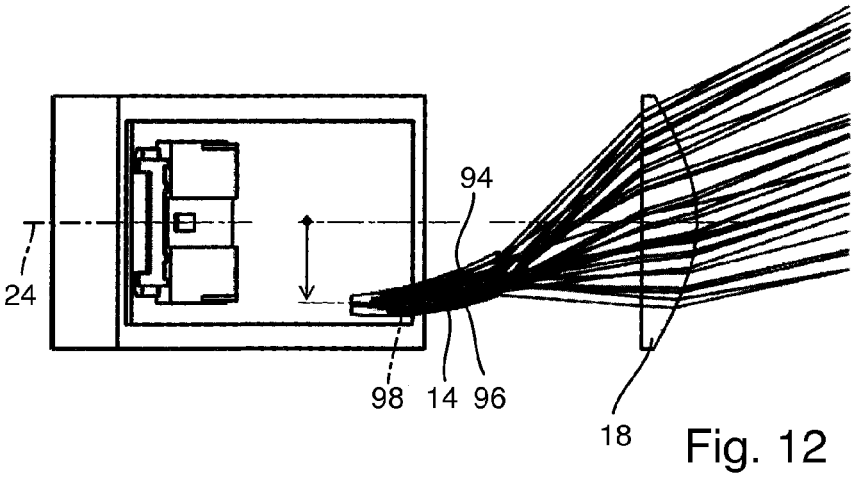

A design for the light conducting section 14, curved in sections parallel to the sagittal plane 22 (plane of sight in FIG. 12) is depicted in FIG. 12. In this case, the further light conducting surfaces 94 and 96 run perpendicular to the sagittal plane 22, but are, however, curved in sections parallel to the sagittal plane 22. Here, the light conducting surfaces 94 and 96 do not run parallel to one another, in particular, but instead, have a slightly deviating course, such that the cross-section surface of the light conducting section 14, in turn, increases continuously as it advances in the light beam direction. Based on the depiction in FIG. 11, the light conducting section 14 shown in FIG. 12 can be obtained in that, instead of the meridional plane 24 as the plane of symmetry for the light conducting section 14, a guide surface 98, which runs along a curve in sections with the sagittal plane 22, is selected, such that the mirror symmetry of the further light conducting surfaces 94 and 96 in relation to the guide surface 98, only applies for infinitesimally small, surface parts of the light conducting surfaces 94 and 96 on the guide surface 98, projected perpendicular to one another. In this regard, the guide surface forms a neutral strand of the light conducting section 14.

In the example of FIG. 12, the light conducting section is also disposed such that it is offset in the direction perpendicular to the meridional plane 24.

The designs of the light conducting section 14 depicted in FIG. 10-12 share the characteristic that the light conducting section 14 exhibits a substantially rectangular shape in sections perpendicular to the main beam direction 20 (or in sections, which are perpendicular to both the meridional plane 24 as well as the sagittal plane 22). With total reflection at the further light conducting surfaces 94 and 96, light beams thus receive no additional directional component perpendicular to the sagittal plane 22.

The curved design of the light conducting section 14 depicted in FIG. 12 is advantageous if numerous light conducting sections 14 are disposed adjacently and are intended to open into a common decoupling section 64 (FIG. 2) or a common secondary lens element formed as a single unit (FIG. 4).

Figure 13B:
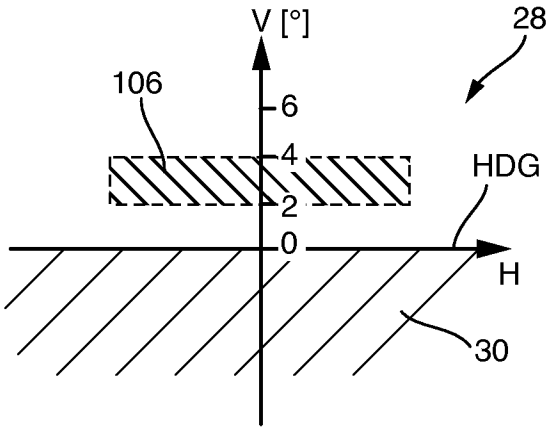
Figure 13A:
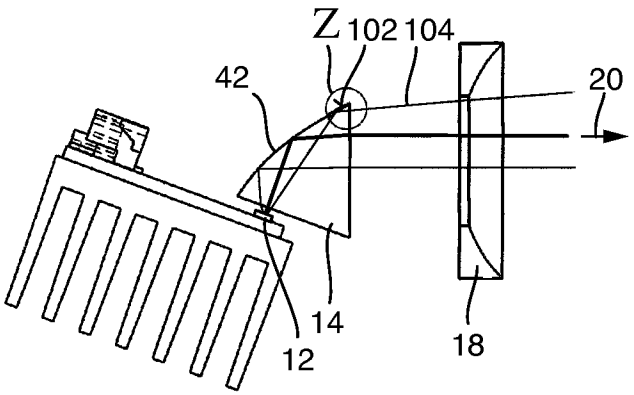
Figure 14:
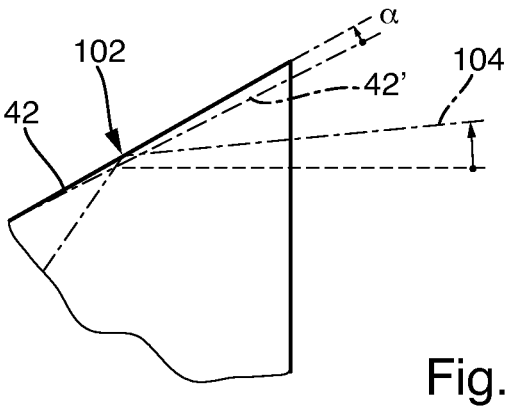

With the designs for the light conducting sections 14 depicted in FIGS. 13 and 14, the main reflection surface 42 of the light conducting section 14 exhibits a facet 102 for the targeted light scattering (FIG. 13*a*). The facet is designed such that a light beam 104 reflected by the main reflection surface 42 in the region of the facet 102 is deflected in a targeted manner in a direction deviating from the reflected light beams in the vicinity of the facet 102. As a result, a light beam distribution 28 of the type shown in FIG. 13*b* can be implemented, for example. This light beam distribution 28 exhibits a light/dark border HDG, which borders a light region 30 lying vertically below it (in the illustration, on a test screen in the manner explained in reference to FIG. 1). The facet 102 deflects a portion of the light emitted by the semiconductor light source 12 in a targeted manner in the dark region above the light/dark border HDG, leading to an illuminated "overhead region" 106 of the light beam distribution 28 having a comparably weaker intensity (cf. FIG. 13*b*). This can serve to illuminate street signs without blinding the oncoming traffic.

Figure 15:
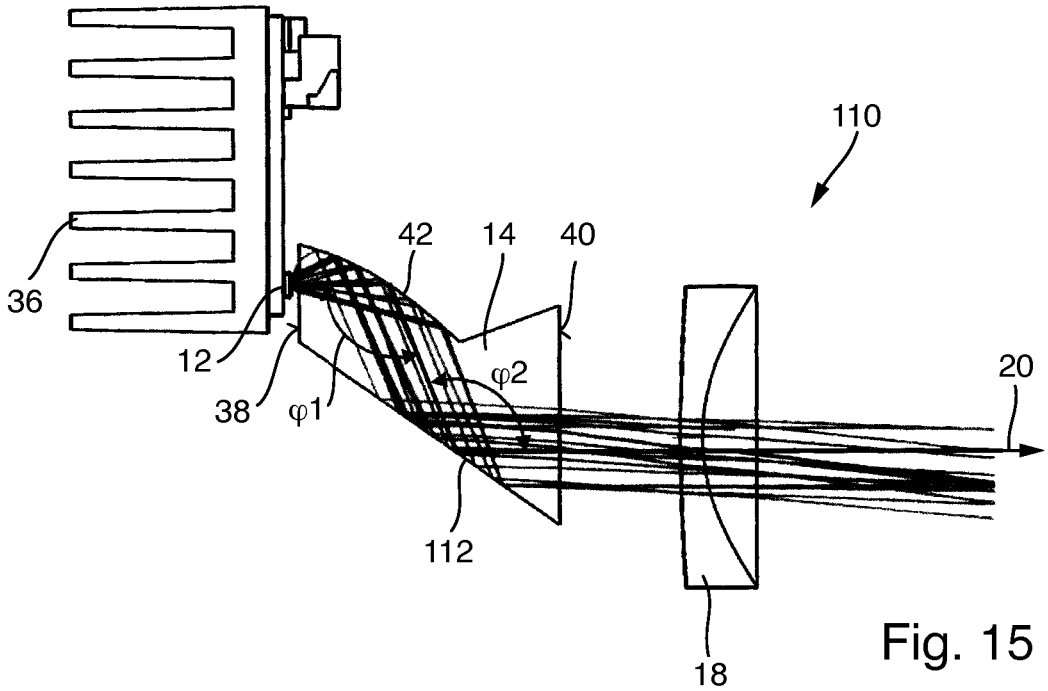
FIG. 15 illustrate another design for a light module according to the invention.

As is visible in the detail view of FIG. 14, the facet 102 can be implemented in that a limited region of the main reflection surface 42 is designed such that it is tilted at a facet angle $\alpha$ in relation to the surrounding course of the main reflection surface 42. In FIG. 14, the course of the main reflection surface 42' without the facet 102 is depicted by a broken line. The light beam 104 is thus deflected to a region above the light/dark border HDG. The facet 102 may be disposed in the edge section of the light conducting section 14 facing the secondary lens element 18. It is thus conceivable that the light conducting section 14 be designed in the manner of the facet 102 in the region of a front edge of the main reflection surface 42. Another design for the light conducting section 14 is described in FIG. 15, which enables the construction of a light module 110 as a further embodiment of the invention. FIG. 15 shows a sectional representation perpendicular to the sagittal plane (cf. FIG. 1). A light conducting section 14 is visible, which extends in a plane in the meridional plane, in the manner of a disk.

The light conducting section 14 differs from the designs described above in that a counter-reflection surface 112 is provided opposite the main reflection surface 42. This is parallel in sections to the meridional plane 24 in its course (illustration plane of FIG. 15), and in particular, is designed as flat or only slightly curved. With respect to the design of the other lateral surfaces of the light conducting section 14, reference is made to the explanations regarding FIGS. 8-14.

The counter-reflection surface 112 is disposed downstream of the main reflection surface 42 in the beam path. The counter-reflection surface 112 has the function of deflecting a light beam guided in the light conducting section 14 once again, after total reflection at the main reflection surface 42, through total reflection in section perpendicular to the sagittal plane. By specifying the orientation of the counter-reflection surface 112, the predominant direction of the light beams exiting the light conducting section 14 through the light decoupling surface 40 can be specified thereby. In the depicted example, the light decoupling surface 40, in differing from the embodiments of the invention described above, is oriented parallel to the light coupling surface 38. Accordingly, the light module 110 has a main beam direction 20 that is rotated by nearly 90°. A construction of this type can be advantageous, for example, if the orientation of the cooling element 36, in relation to the embodiments described above, must be modified due to spatial limitations, for example.

Figure 16A:
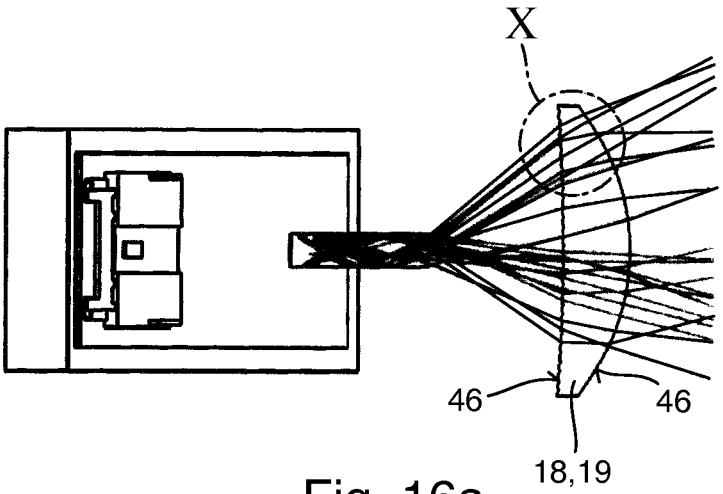
FIGS. 16 and 17 illustrate the design for the secondary lens element.
Figure 16B:
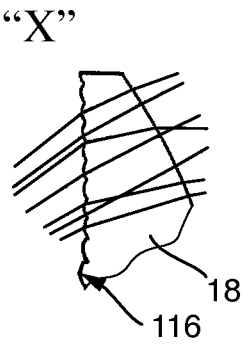

FIG. 16 shows another design for a secondary lens element 18 designed as a cylindrical lens 19, as can be used in all of the light modules according to the invention. The cylindrical lens 19 exhibits drum-type structures 116 on its light passage surface 46 facing the primary lens element 16 (in particular, the light conducting sections 14), which are illustrated more clearly in the detail view according to FIG. 16*b*. In the region of the drum-type structures 16, the light passage surface 46 arches cylindrically about a drum axis running parallel to the cylinder axis 48 of the cylindrical lens 19 (cf. FIG. 1). As a result, individual light beams are scattered in opposition to the overall concentrated effect in sections parallel to the sagittal plane, which can lead to a better homogeneity of the light beam distribution of the light module.

Figure 17:
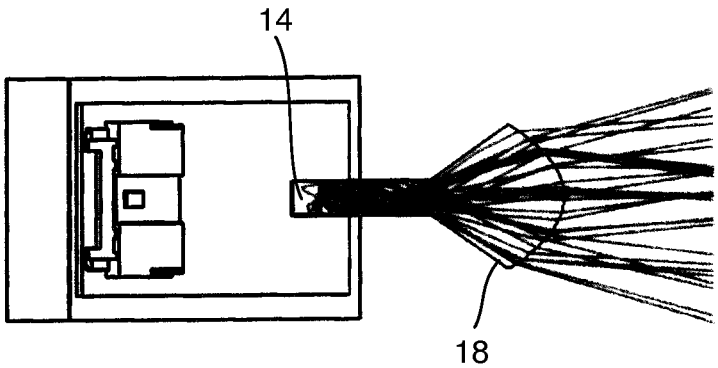

FIG. 17 shows a design in which the secondary lens element 18 is formed by a light emitting section formed as a single unit on the light conducting section 14, having a cylindrical lens surface with cylindrical arches.

Figure 18:
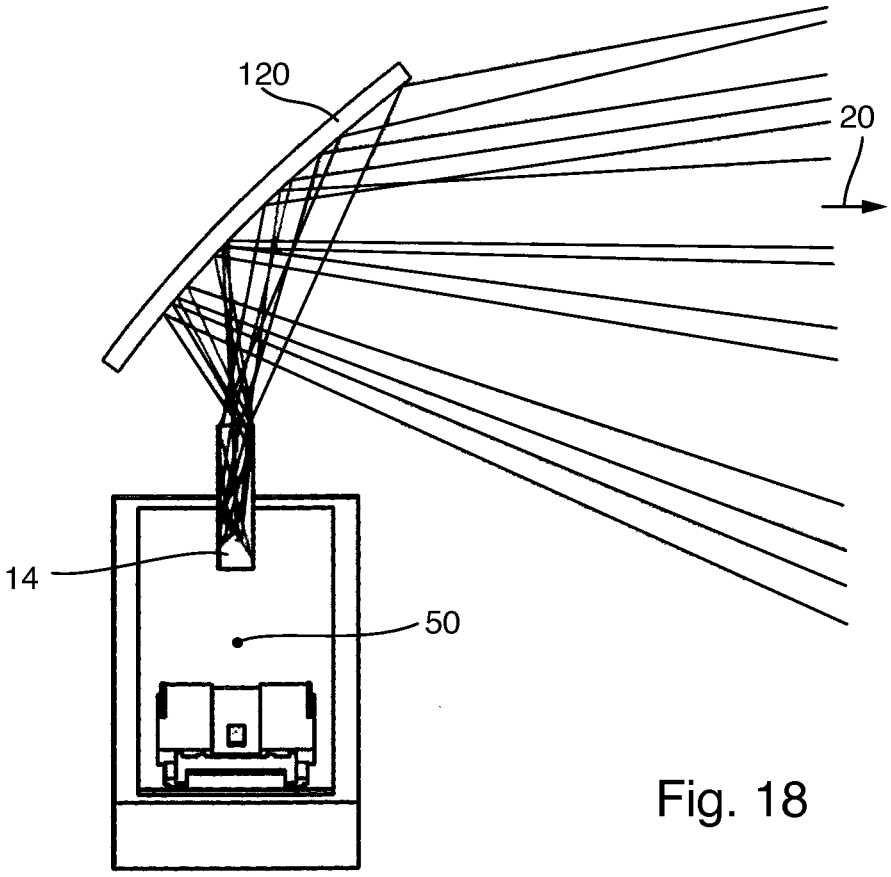
FIG. 18 illustrates an alternative design of the light module.

It is fundamentally possible with the light modules according to the invention that the common secondary lens element 18 is formed by a cylindrical reflector 120. This is illustrated in FIG. 18. The cylindrical reflector 12 is designed as a segment of a cylindrical hollow mirror, exhibiting a parabolic course in sections in the sagittal plane (illustration plane of FIG. 18). As a result, a secondary focal line 50 running perpendicular to the sagittal plane 22 can be allocated to the cylindrical reflector 120, which extends perpendicular to the plane of the drawing in FIG. 18. In addition to the collimating effect for the diverging light cluster starting from the secondary focal line 50 in sections parallel to the sagittal plane, the cylindrical reflector deflects the light beams exiting the light conducting section 14. As a result, with a suitable orientation of the cylindrical reflector 120, the main beam direction 20 of the light module can be defined.

Figure 19A:
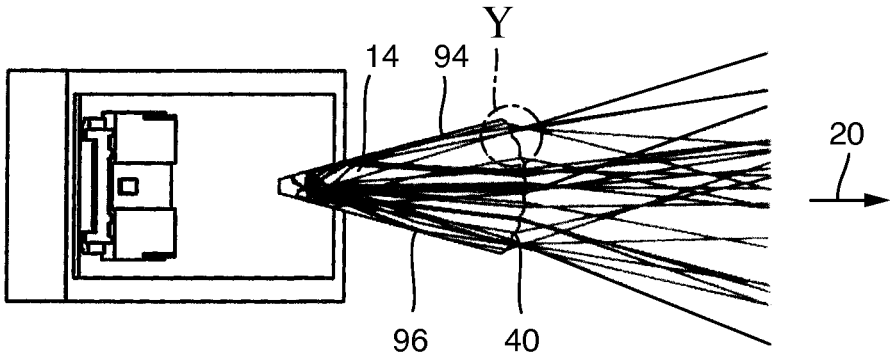
FIGS. 19*a* and 19*b* illustrate still another design for the light module.
Figure 19B:
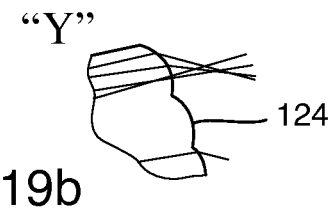

FIG. 19 shows another design for the light conducting section 14, which can likewise be used in all of the light modules according to the invention. The light decoupling surface 40 of a light conducting section 14 can exhibit drum-like scattering structures 124, which are visible in the detail view of FIG. 19*b* for the configuration according to FIG. 19*a*. In the region of a scattering structure 124, the light decoupling surface 40 exhibits a convex curved course, in particular, a cylindrical or parabolic course in section parallel to the sagittal plane 22 (plane of illustration in FIG. 19). To this extent, the light decoupling surface 40 is curved in the region of a scattering structure 124, in each case about a drum axis which is oriented perpendicular to the sagittal plane 22. This leads to a scattering of the light beams in sections parallel to the sagittal plane 22, and thus to a homogenization of the light beam distribution. In the example in FIG. 19, the light conducting section 14 exhibits further light conducting surfaces 94 and 96, extending perpendicular to the sagittal plane 22, which spread out in the direction of the main beam direction. This contributes to a collimation of the light guided in the light conducting section 14, in sections parallel to the sagittal plane 22.

What is claimed is:

1. A light module for a lighting system of a motor vehicle, comprising: a plurality of semiconductor light sources for emitting light; a primary lens element for concentrating the light emitted from the semiconductor light sources in sections perpendicular to a sagittal plane of the light module, wherein the primary lens element includes a plurality of disk-like light conducting sections extending in a plane perpendicular to the sagittal plane, wherein each light conducting section includes a light coupling surface and a light decoupling surface, and is designed to conduct light, with total internal reflection, from the light coupling surface to the light decoupling surface, wherein each light conducting section is allocated to a semiconductor light source such that light from the semiconductor light source can be coupled with the respective light coupling surface in the light conducting section, wherein each light conducting section includes a main reflection surface, which is convex curved with a parabolic shape such that a primary focal line allocated in each case to the light conducting section is defined, wherein the primary focal line extends in, or parallel to, the sagittal plane; and a secondary lens element provided downstream of the primary lens element in the beam path, wherein the secondary lens element is a cylindrical lens that defines a secondary focal line that runs perpendicular to the primary focal line such that the light passing through the plurality of light decoupling surfaces of the plurality of light conduction sections can be concentrated in sections parallel to the sagittal plane by the secondary lens element and wherein the light decoupling surfaces of the light conducting sections lie between the secondary focal line and the secondary lens element.

2. The light module as set forth in claim 1, wherein the light conducting sections extend running adjacently to one another, and open into a shared decoupling section of the primary lens element, on which the light decoupling surfaces are disposed.

3. The light module as set forth in claim 1, wherein the main reflection surface includes a facet for light scattering.

4. The light module as set forth in claim 1, wherein each semiconductor light source includes a flat light emitting surface bordered by at least one straight boundary edge, wherein the boundary edge runs on the primary focal line of the light conducting section allocated thereto, or on the primary focal line of the light conducting section allocated thereto, through the light emitting surface.

5. The light module as set forth in claim 4, wherein the light coupling surface is flat and is tilted in relation to the light emitting surface such that a spacing gap is formed, having a size that varies over the course of the light emitting surface.

6. The light module as set forth in claim 1, wherein the light decoupling surfaces extend perpendicular to the sagittal plane and perpendicular to the main beam direction of the light module.

7. The light module as set forth in claim 1, wherein the secondary lens element concentrates light in sections in or parallel to the sagittal plane.

8. The light module as set forth in claim 7, wherein the cylindrical lens forming the secondary lens element and the light conducting sections forming the primary lens element are formed as a single unit.

* * * * *